US010959526B2

(12) United States Patent
Leng

(10) Patent No.: US 10,959,526 B2
(45) Date of Patent: Mar. 30, 2021

(54) FOLDING CHAIR

(71) Applicant: New-Tec Integration (Xiamen) Co., Ltd., Xiamen (CN)

(72) Inventor: Luhao Leng, Xiamen (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 16/676,748

(22) Filed: Nov. 7, 2019

(65) Prior Publication Data

US 2020/0138191 A1 May 7, 2020

(30) Foreign Application Priority Data

Nov. 7, 2018 (CN) ..... 201821829621.0

(51) Int. Cl.

| | |
|---|---|
| ***A47C 4/04*** | (2006.01) |
| ***A47C 4/44*** | (2006.01) |
| ***A47C 4/10*** | (2006.01) |
| ***A47C 4/20*** | (2006.01) |

(52) U.S. Cl.

CPC ..... *A47C 4/04* (2013.01); *A47C 4/10* (2013.01); *A47C 4/20* (2013.01); *A47C 4/44* (2013.01)

(58) Field of Classification Search

CPC .... A47C 4/10; A47C 4/20; A47C 4/44; A47C 4/34; A47C 7/02; A47C 7/002; A47C 4/04; A47B 91/12; A47B 91/06

USPC ..... 297/55, 463.1; 16/42 T; 248/188.9

See application file for complete search history.

(56) References Cited

U.S. PATENT DOCUMENTS

| | | | | |
|---|---|---|---|---|
| 1,806,084 | A * | 5/1931 | Roe | A47C 7/002 248/188.9 |
| 7,219,955 | B2 * | 5/2007 | Lu | A47C 4/20 297/58 |
| 7,753,439 | B2 * | 7/2010 | Akkad | A47C 4/10 297/23 |
| 8,496,296 | B2 * | 7/2013 | Fusao | A47C 4/02 297/440.24 |
| 2008/0084094 | A1 * | 4/2008 | Voris | A47C 4/20 297/16.2 |

* cited by examiner

*Primary Examiner* — Milton Nelson, Jr.

(74) *Attorney, Agent, or Firm* — Cooper Legal Group, LLC

(57) ABSTRACT

The present disclosure discloses a folding chair comprising a seat plate, a back plate, two front legs, and two rear legs. Each of the two front legs is connected with a joint. The joint is disposed between the back plate and the seat plate, and the joint extends rearward to form an extension portion. A rear end of the extension portion is rotatably connected to a top end of a corresponding one of the two rear legs, and a barrier extends from a rear edge of each of the two front legs or a front edge of each of the two rear legs. When the folding chair is folded, the barrier separates each of the two front legs from a corresponding one of the two rear legs and provides an accommodation space for fingers between each of the two front legs and the corresponding one of the two rear legs.

6 Claims, 9 Drawing Sheets

FOLDING CHAIR

RELATED APPLICATIONS

This application claims priority to Chinese Patent Application 201821829621.0, filed on Nov. 7, 2018. Chinese Patent Application 201821829621.0 is incorporated herein by reference.

FIELD OF THE DISCLOSURE

The present disclosure relates to a folding chair.

BACKGROUND OF THE DISCLOSURE

The traditional folding chair comprises front legs, rear legs and a seat plate. After the traditional folding chair is folded, the front legs and the rear legs can be brought together to be vertically placed, and the seat plate can also be turned upward to be vertically placed. As such, a footprint of the traditional folding chair is greatly reduced, which is convenient for transportation and storage. The folding chair is widely used and has a long history, and it brings great convenience to the user.

When the folding chair is in a folding state, the front legs and the rear legs of the folding chair are close together, and a gap between the front legs and the rear legs is very small. When the folding chair is transported or folded, the front legs and the rear legs are held by a hand of a user, and the fingers are easily pinched by the front legs and the rear legs. Therefore, it may potentially cause harm to people, especially children.

BRIEF SUMMARY OF THE DISCLOSURE

The present disclosure provides a folding chair with an anti-pinch function. In order to solve the aforementioned technical problems, the technical solution adopted by the present disclosure is as follows:

A folding chair, comprising a seat plate, a back plate, two front legs and two rear legs. A left side and a right side of the seat plate are respectively symmetrically disposed with a corresponding one of the two front legs. A left edge and a right edge of the seat plate are respectively rotatably connected to a middle portion of the corresponding one of the two front legs or are respectively rotatably and slidably connected to the middle portion of the corresponding one of the two front legs. The left side and the right side of the seat plate are respectively symmetrically disposed with a corresponding one of the two rear legs. The left edge and the right edge of the seat plate are respectively rotatably connected to the corresponding one of the two rear legs or are respectively rotatably and slidably connected to the middle portion of the corresponding one of the two front legs. Each of the two front legs and a corresponding one of the two rear legs disposed on a same side of the seat plate form a foldable bracket shaped as herringbone, and the back plate is disposed between a top portion of a first one of the two front legs and a top portion of a second one of the two front legs. Each of the two front legs is connected with a joint, and the joint is disposed between the back plate and the seat plate. The joint extends rearward to form an extension portion, and a rear end of the extension portion is rotatably connected to a top end of a corresponding one of the two rear legs. A barrier extends from a rear edge of each of the two front legs or a front edge of each of the two rear legs. When the folding chair is folded, the barrier separates each of the two front legs from a corresponding one of the two rear legs and provides an accommodation space for fingers between each of the two front legs and the corresponding one of the two rear legs.

Compared with existing techniques, the technical solution has the following advantages:

Since the joint disposed on the front leg comprises the extension portion extending rearward, each of the two rear legs is rotatably connected to the extension portion, a connecting position of each of the two rear legs and a corresponding one of the two front legs is rearward moved, and a barrier extends from the rear side of each of the two front legs or the front side of each of the two rear legs, when the folding chair is folded each of the two front legs and a corresponding one of the two rear legs do not close together. The extension portion and the barrier cooperate to prevent each of the two front legs and a corresponding one of the two rear legs from closing together, so that the accommodation space for fingers is provided between each of the two front legs and the corresponding one of the two rear legs to avoid causing the fingers to be pinched.

BRIEF DESCRIPTION OF THE DRAWING

The present disclosure will be further described below with the combination of the accompanying drawings together with the embodiments.

DETAILED DESCRIPTION OF THE EMBODIMENTS

Embodiment 1

Figure 1:
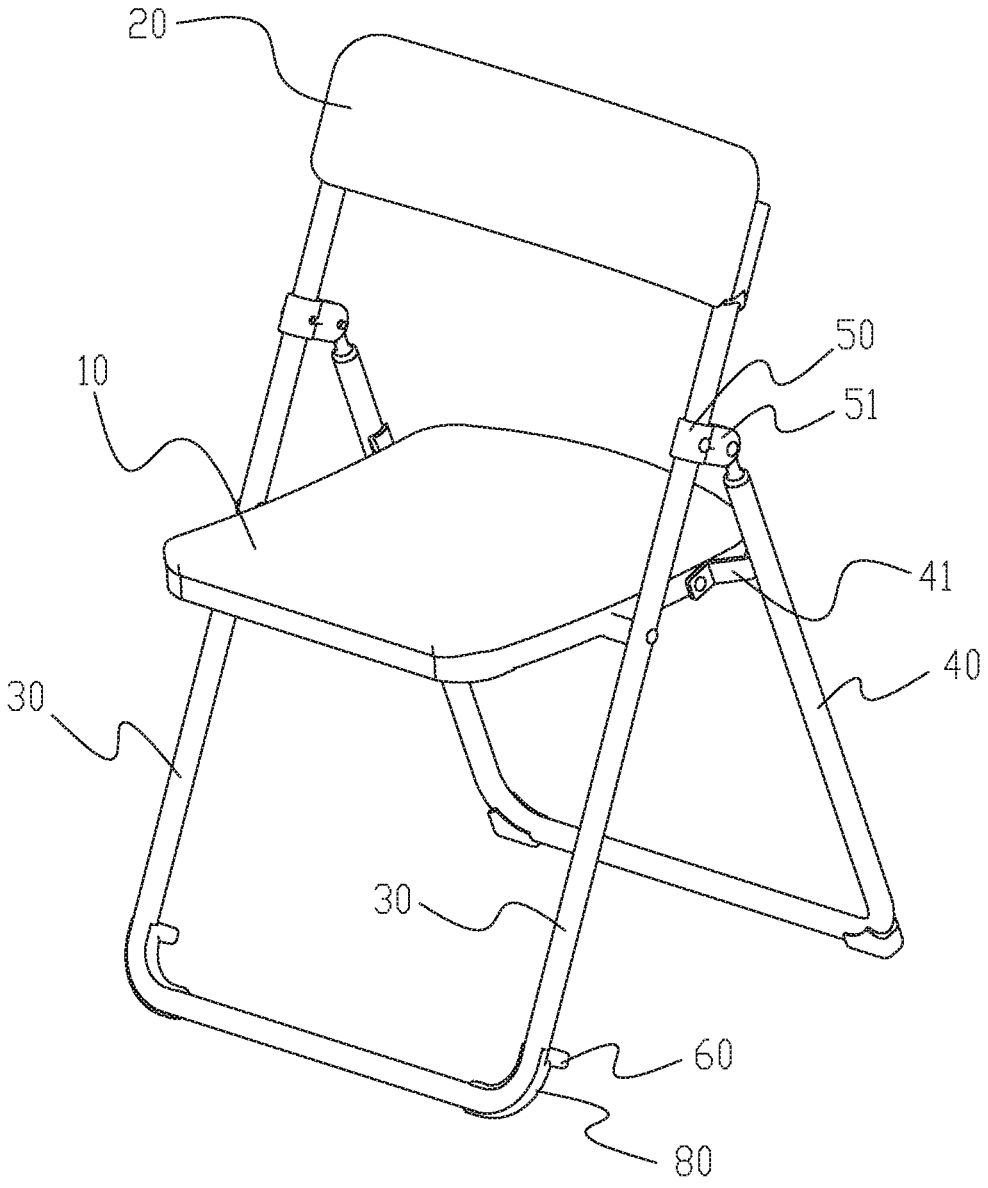
FIG. 1 illustrates a first perspective view of a folding chair in Embodiment 1 of the present disclosure.
Figure 2:
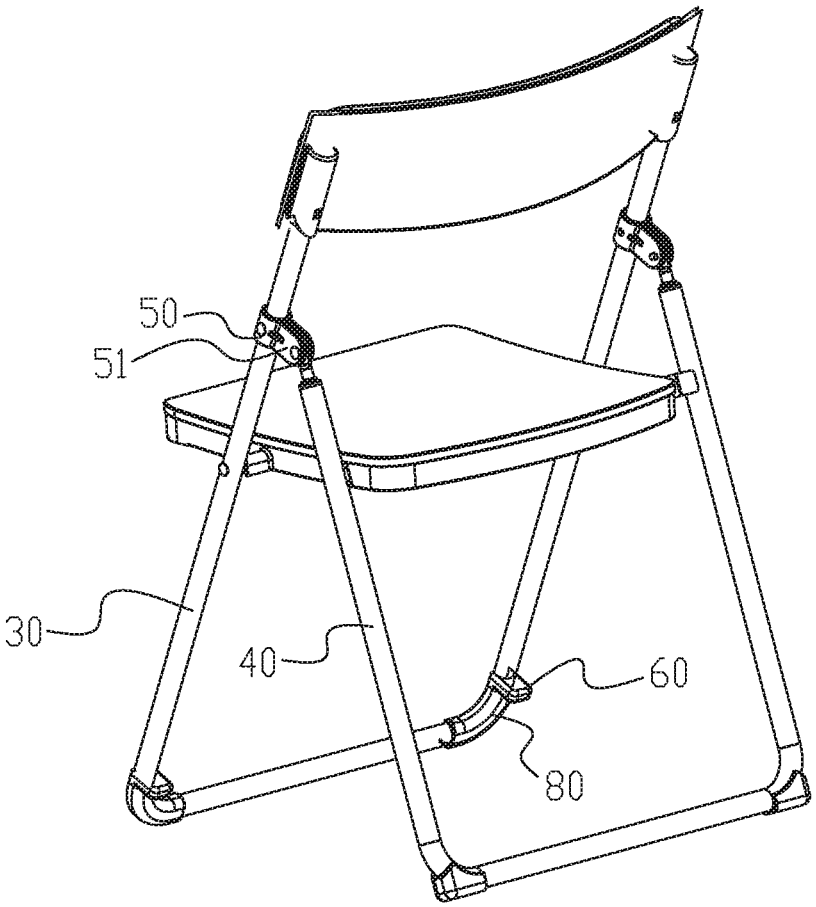
FIG. 2 illustrates a second perspective view of the folding chair shown in FIG. 1.
Figure 3:
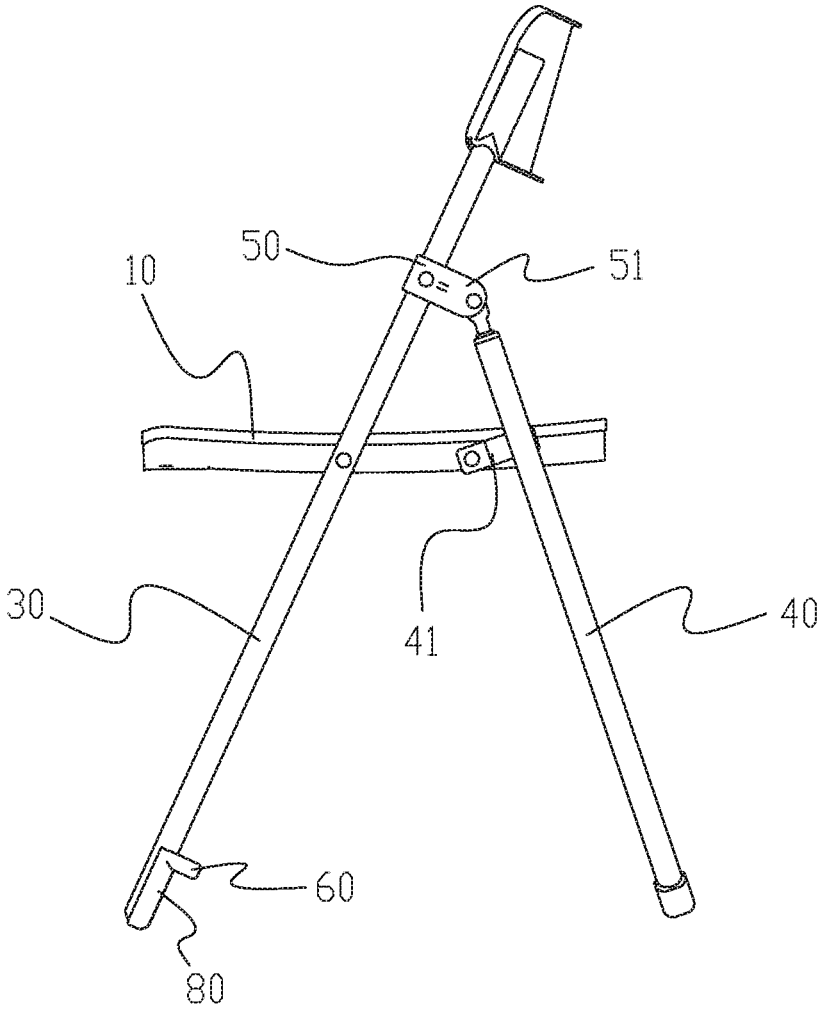
FIG. 3 illustrates a side view of the folding chair shown in FIG. 1.
Figure 4:
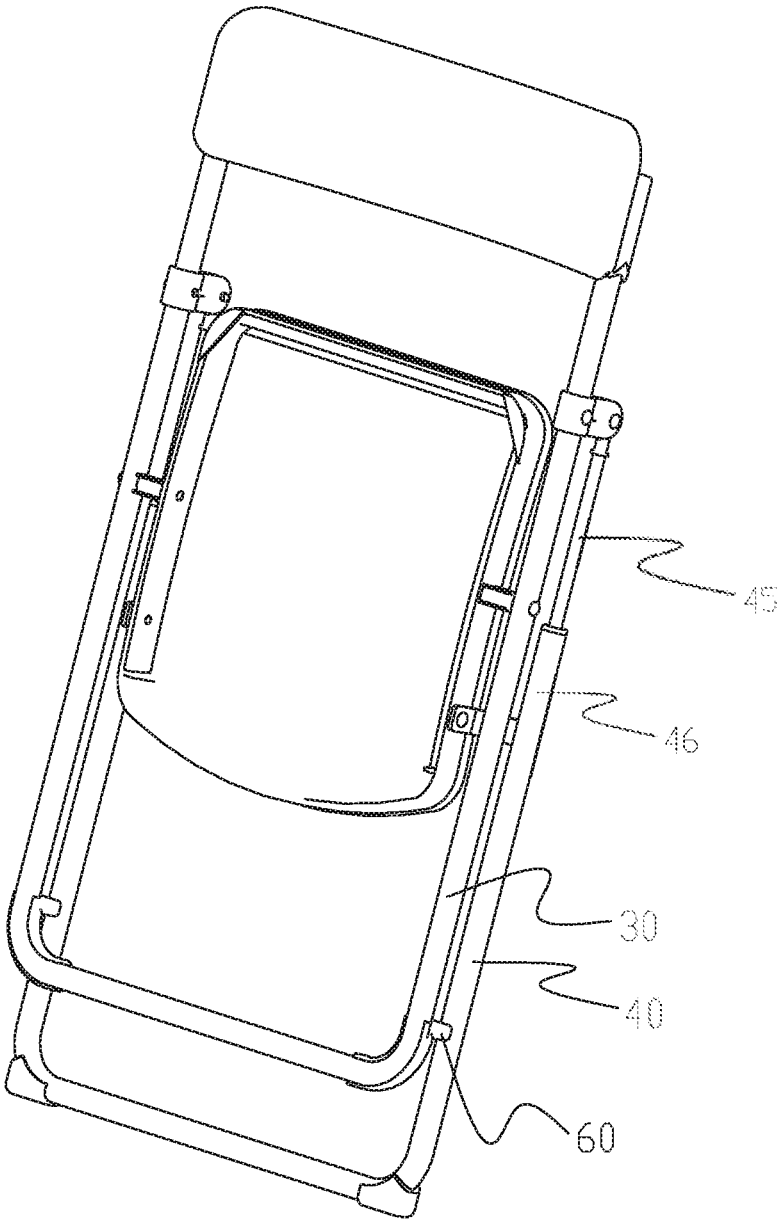
FIG. 4 illustrates a schematic view of the folding chair shown in FIG. 1 when the folding chair is folded.
Figure 5:
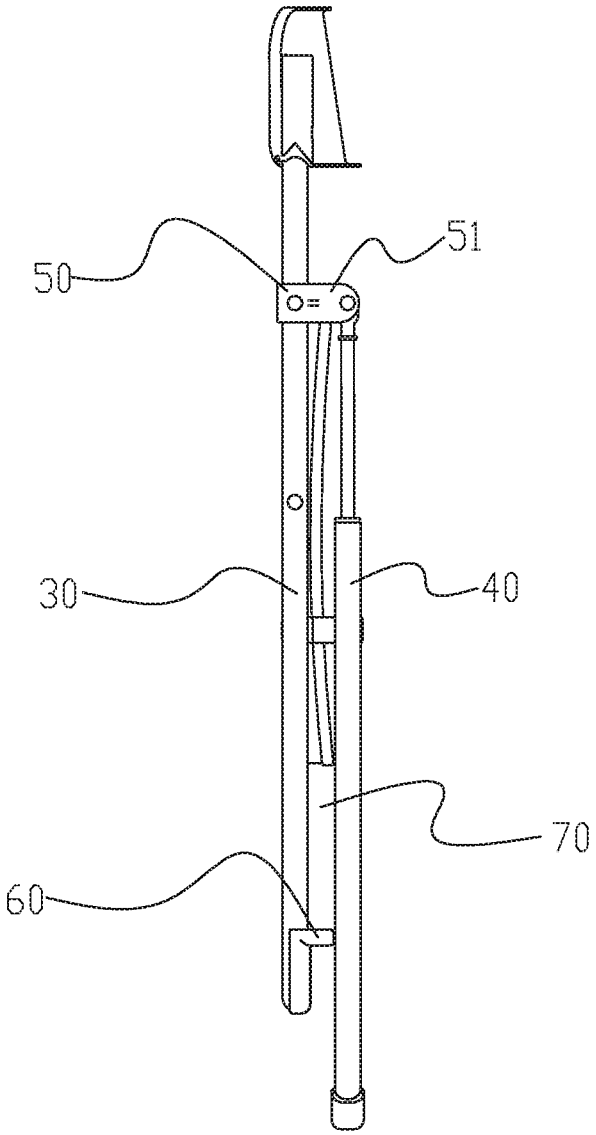
FIG. 5 illustrates a side view of the folding chair shown in FIG. 1 when the folding chair is folded.

Referring to FIGS. 1 to 5, a folding chair comprises a seat plate 10, a back plate 20, two front legs 30, and two rear legs 40. The two front legs 30 are respectively symmetrically disposed on a left side and a right side of the seat plate 10. A left edge and a right edge of the seat plate 10 are respectively connected to a middle portion of a corresponding one of the two front legs 30 in a rotating manner or in a rotating and sliding manner. The back plate 20 is disposed between a top portion of a first one of the two front legs 30 and a second one of the two front legs 30. The left side and the right side of the seat plate 10 are respectively symmetrically disposed with a corresponding one of the two rear legs 40. The left edge and the right edge of the seat plate 10 are respectively symmetrically connected to a corresponding one of the two rear legs 40 in a rotating manner or in a rotating and sliding manner. Each of the two front legs 30 is connected with a joint 50. The joint 50 is disposed between the back plate 20 and the seat plate 10, and the joint 50 extends rearward to form an extension portion 51. A rear end of the extension portion 51 is respectively rotatably connected to a top end of a corresponding one of the two rear legs 40. Each of the two front legs 30 and a corresponding one of the two rear legs 40 disposed on a same side of the seat plate 10 form a foldable bracket shaped as herringbone. A rear edge of each of the two front legs 30 is disposed with a barrier 60. When the folding chair is folded, the barrier 60 separates each of the two front legs 30 from a corresponding one of the two rear legs 40 and forms an accommodation space 70 for fingers between each of the two front legs 30 and a corresponding one of the two rear legs 40.

Preferably, when the folding chair is folded, the two front legs 30 are parallel to the two rear legs 40. An upper portion of each of the two rear legs 40 is disposed with a connecting piece 41, and the connecting piece 41 is rotatably connected to the seat plate 10. Each of the two rear legs 40 is retractable and comprises an inner tube 45 and an outer tube 46. The inner tube 45 is configured to be retracted relative to the outer tube 46. When the folding chair is unfolded, the inner tube 45 is received in the outer tube 46. When the folding chair is folded, the inner tube 45 extends out of the outer tube 46.

A bottom of each of the two front legs 30 is disposed with a leg cushion 80, and the barrier 60 is connected to the leg cushion 80. The barrier 60 and the leg cushion 80 are integrally formed. The leg cushion 80 is shaped as a shell that encloses a corresponding one of the two front legs 30, and the leg cushion 80 is fastened to the corresponding one of the two front legs 30 or locked to the corresponding one of the two front legs 30.

Embodiment 2

Figure 6:
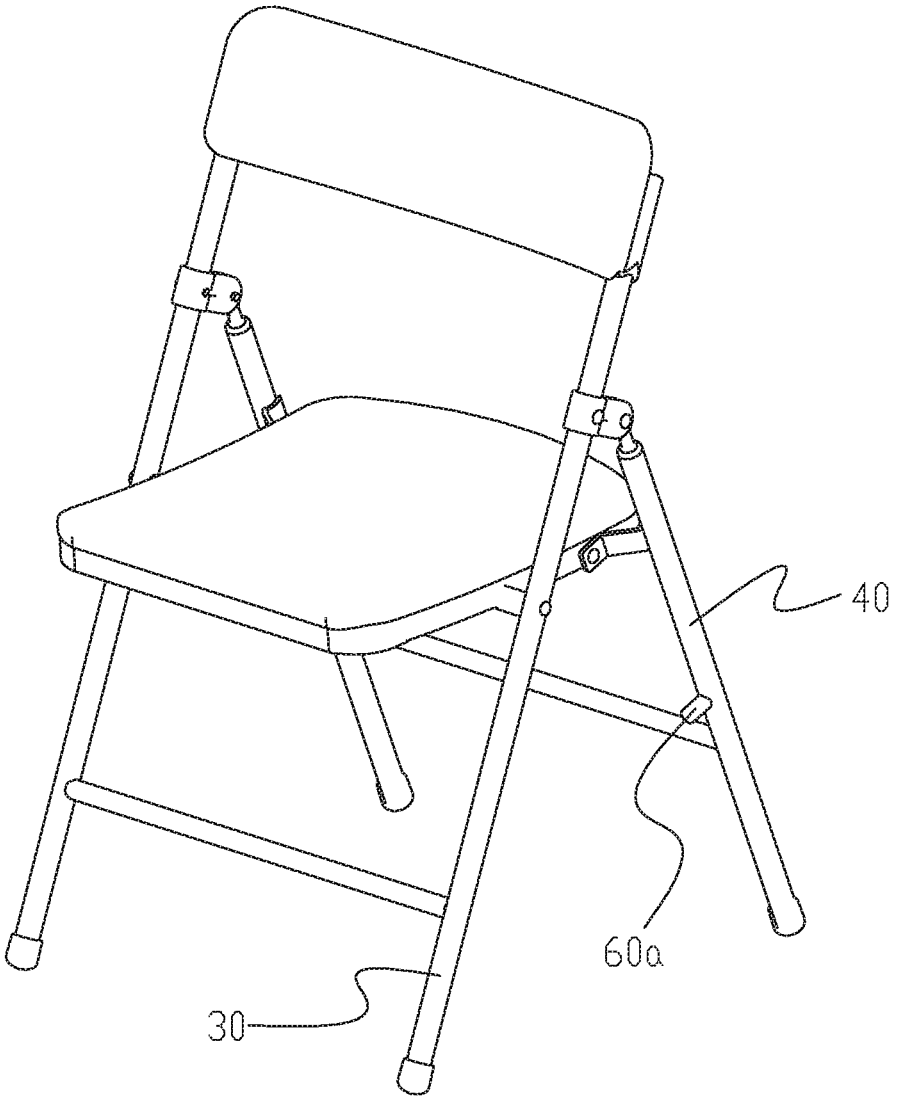
FIG. 6 illustrates a perspective view of a folding chair in Embodiment 2 of the present disclosure.
Figure 7:
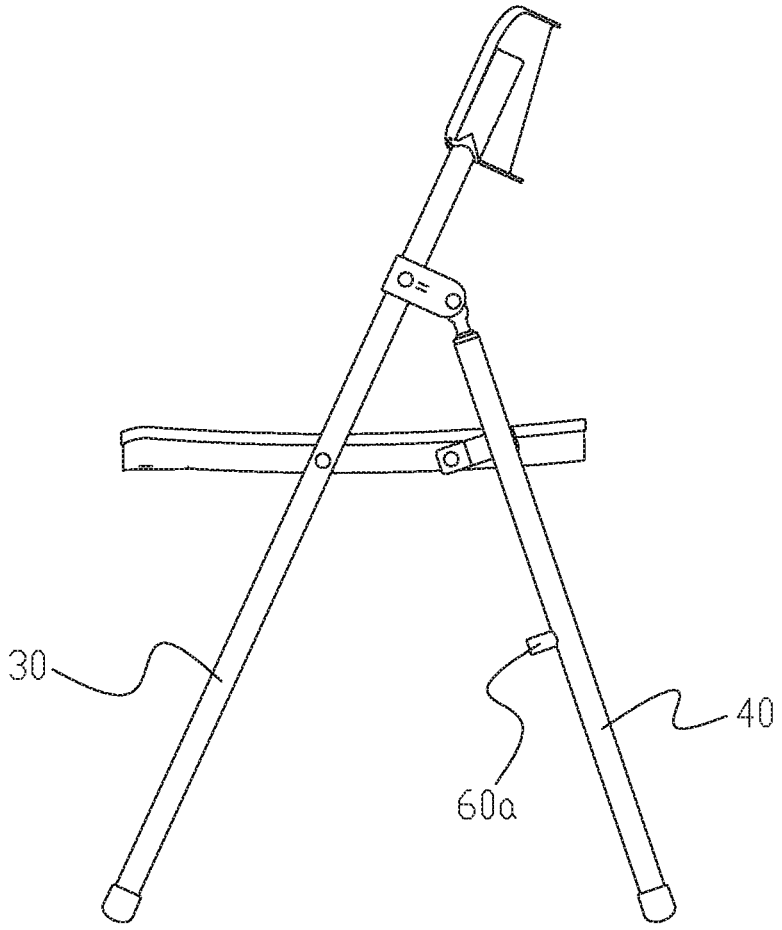
FIG. 7 illustrates a side view of the folding chair shown in FIG. 6.
Figure 8:
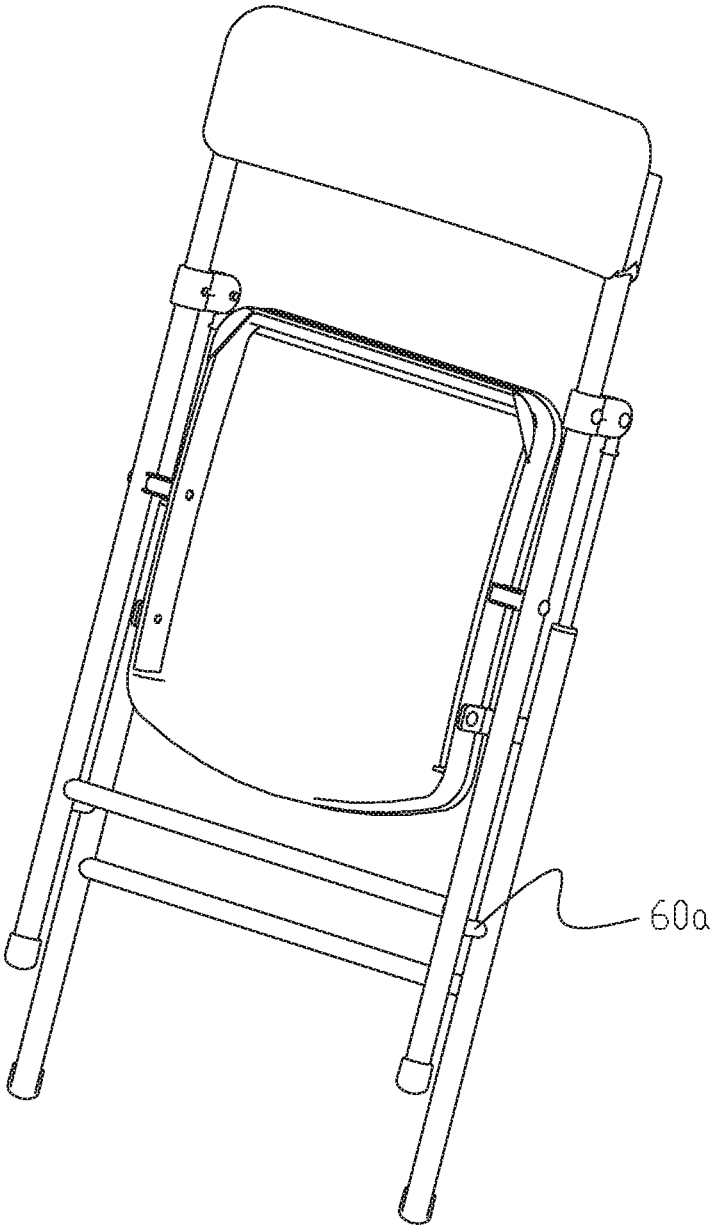
FIG. 8 illustrates a schematic view of the folding chair shown in FIG. 6 when in folding chair is folded.
Figure 9:
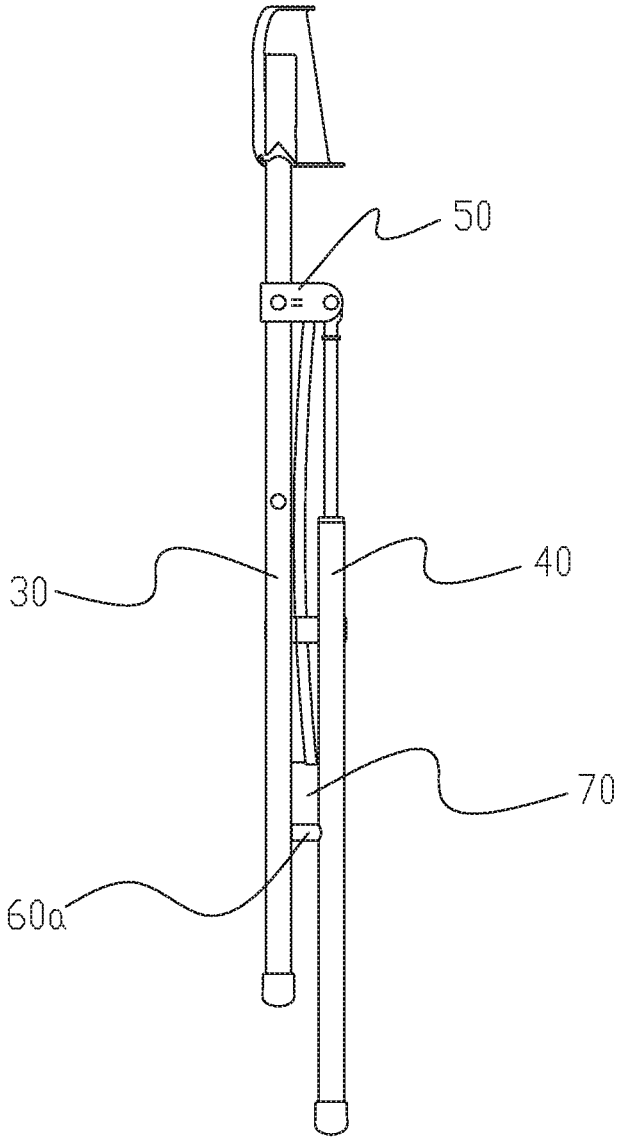
FIG. 9 illustrates a side view of the folding chair shown in FIG. 6 when the folding chair is folded.

Referring to FIGS. 6-9, the folding chair in this embodiment is different from Embodiment 1 in that the barrier 60*a* is connected to a front side of each of the two rear legs 40 and has a columnar structure.

It will be apparent to those skilled in the art that various modifications and variations can be made in the present disclosure without departing from the spirit or scope of the invention. Thus, it is intended that the present disclosure cover the modifications and variations of this invention provided they come within the scope of the appended claims and their equivalents.

What is claimed is:

1. A folding chair, comprising:
a seat plate,
a back plate,
two front legs, and
two rear legs, wherein:
a left side and a right side of the seat plate are respectively symmetrically disposed with a corresponding one of the two front legs,
a left edge and a right edge of the seat plate are respectively rotatably connected to a middle portion of the corresponding one of the two front legs or are respectively rotatably and slidably connected to the middle portion of the corresponding one of the two front legs,
the left side and the right side of the seat plate are respectively symmetrically disposed with a corresponding one of the two rear legs,
the left edge and the right edge of the seat plate are respectively rotatably connected to the corresponding one of the two rear legs or are respectively rotatably and slidably connected to the corresponding one of the two rear legs,
each of the two front legs and a corresponding one of the two rear legs disposed on a same side of the seat plate form a foldable bracket shaped as a herringbone,
the back plate is disposed between a top portion of a first one of the two front legs and a top portion of a second one of the two front legs,
each of the two front legs is connected with a joint,
the joint is disposed between the back plate and the seat plate,
the joint extends rearward to form an extension portion,
a rear end of the extension portion is rotatably connected to a top end of a corresponding one of the two rear legs,
a barrier extends from a rear edge of each of the two front legs or a front edge of each of the two rear legs,
a leg cushion is disposed at a bottom of each of the two front legs,
the barrier is connected to the leg cushion,
the barrier and the leg cushion are integrally formed,
the leg cushion is shaped as a shell and encloses a corresponding one of the two front legs, and
when the folding chair is folded, the barrier separates each of the two front legs from a corresponding one of the two rear legs and provides an accommodation space for fingers between each of the two front legs and the corresponding one of the two rear legs.

2. The folding chair according to claim 1, wherein:
when the folding chair is folded, the two front legs are parallel to the two rear legs.

3. The folding chair according to claim 2, wherein:
the barrier is connected to a corresponding one of the two rear legs, and
the barrier has a columnar configuration.

4. The folding chair according to claim 1, wherein:
each of the two rear legs is retractable.

5. The folding chair according to claim 4, wherein:
a connecting piece is disposed on an upper portion of each of the two rear legs,
the connecting piece is rotatably connected to the seat plate, and
each of the two front legs is rotatably connected to the seat plate.

6. The folding chair according to claim 1, wherein:
the barrier is connected to a corresponding one of the two rear legs, and
the barrier has a columnar configuration.

* * * * *